US005218353A

United States Patent [19]

Okumura et al.

[11] Patent Number: 5,218,353

[45] Date of Patent: Jun. 8, 1993

[54] DISPLAY DEVICE FOR A RECORDING DEVICE CAPABLE OF DISPLAYING A PLURALITY OF OPERATING STATES OR CONDITIONS IN EFFECT

[75] Inventors: Takashi Okumura, Nagoya; Kengo Omura, Toyoake, both of Japan

[73] Assignee: Brother Kogyo Kabushiki Kaisha, Nagoya, Japan

[21] Appl. No.: 679,108

[22] Filed: Apr. 2, 1991

[30] Foreign Application Priority Data

Aug. 13, 1990 [JP] Japan ..... 2-214562

[51] Int. Cl.[5] ..... G08B 5/22

[52] U.S. Cl. ..... 340/815.01; 340/815.03; 400/74; 400/711; 346/76 PH

[58] Field of Search ..... 340/815.01, 815.02, 340/815.03, 815.04, 715, 711, 523, 543, 825.32, 679; 355/206, 207, 208, 209; 320/13; 341/23; 400/74, 711, 703; 346/76 PH, 86, 87, 184, 185; 358/441, 468, 406, 404

[56] References Cited

U.S. PATENT DOCUMENTS

| | | | |
|---|---|---|---|
| 3,673,351 | 6/1972 | Niioka et al. | 340/525 |
| 4,836,699 | 6/1989 | Babsch et al. | 400/711 |
| 4,853,676 | 8/1989 | Kitts | 340/636 |
| 4,908,603 | 3/1990 | Yamaue et al. | 340/271 |

FOREIGN PATENT DOCUMENTS

| | | | |
|---|---|---|---|
| 0202879 | 8/1986 | Japan | 400/74 |
| 1587362 | 4/1981 | United Kingdom . | |
| 2207822A | 2/1989 | United Kingdom . | |
| 2226197A | 6/1990 | United Kingdom . | |

OTHER PUBLICATIONS

Owner's Manual Matrix Printer SL-90, Seikosha, 1989, pp. 2-4 and 19-22 and 31.

*Primary Examiner*—Ulysses Weldon
*Assistant Examiner*—Chanh Nguyen
*Attorney, Agent, or Firm*—Oliff & Berridge

[57] ABSTRACT

In a display device for a recording device, when the power supply of the recording device is switched on, a display lamp is lighted to display that power-on. When the recording device is operated, and recording information is input, a misoperation detection circuit detects misoperation. When a misoperation is detected, a controller controls the display lamp to indicate the misoperation. When a device-trouble is detected, such as lowering of voltage in the recording device, the controller controls the display lamp to indicate the misoperation. The display lamp displays for indicating device-trouble differs from both the display at power-on and the display indicating a misoperation.

14 Claims, 8 Drawing Sheets

INPUT CONTROL PROCESS

S100
YES
NO
S102
YES
NO
S110
S104
YES
NO
S111
NO
YES
S106
S108
1
S112
YES
NO
S114
YES
NO
S116
S118
S120
YES
NO
S122
S119
NO
YES
1
S124
YES
NO
S126
YES
NO
S128
S130
S132
YES
NO
S134
YES
NO
S136
S138
S140
YES
NO
S142
S144
1
RETURN

Fig.4B

| ITEM | INSTRUCTIONS |
|---|---|
| S100 | PRINT? |
| S102 | "BATTERY WEAK"? |
| S104 | "ERROR"? |
| S106 | PRINT PROCESS |
| S108 | FIRST ON-AND-OFF PERIOD DISPLAY |
| S110 | SECOND ON-AND-OFF PERIOD DISPLAY |
| S111 | ENTER KEY DEPRESSED? |
| S112 | FEED? |
| S114 | "BATTERY WEAK"? |
| S116 | FEED PROCESS |
| S118 | SECOND ON-AND-OFF PERIOD DISPLAY |
| S119 | ENTER KEY DEPRESSED? |
| S120 | FUNCTION? |
| S122 | FUNCTION MODE PROCESS |
| S124 | LINEOUT? |
| S126 | "ERROR"? |
| S128 | LINEOUT PROCESS |
| S130 | FIRST ON-AND-OFF PERIOD DISPLAY |
| S132 | DELETE? |
| S134 | "ERROR"? |
| S136 | DELETE PROCESS |
| S138 | FIRST ON-AND-OFF PERIOD DISPLAY |
| S140 | "ERROR"? |
| S142 | CHARACTER INPUT PROCESS |
| S144 | FIRST ON-AND-OFF PERIOD DISPLAY |

DISPLAY DEVICE FOR A RECORDING DEVICE CAPABLE OF DISPLAYING A PLURALITY OF OPERATING STATES OR CONDITIONS IN EFFECT

BACKGROUND OF THE INVENTION

1. Field of the Invention

The present invention relates to a display device for a recording device. The display device has a display means for notifying users that power is on and for indicating improper operation and potential problems.

2. Description of Related Art

In a conventional recording device, a display lamp is provided as a display means for displaying power-on. Thus, when a user switches power on, a display lamp is turned on and when the user switches power off, the display lamp is turned off to inform the user of the ON/OFF power state.

In such a conventional recording device, only the ON/OFF power state is displayed by a display lamp. Therefore in the case of other conditions, for example, the state of a battery voltage and whether or not it is too low, a notifying means for a battery checker has to be provided in addition to the display lamp for indicating the ON/OFF power state. In some cases, a notifying means for notifying the operator of improper operation of the recording device is also provided. To notify a user of a plurality of states of a recording device, a notifying means of each of these states is needed, which makes it necessary to provide many notifying means. The result of the need for these various notification means is that they make a recording device large or make the device so complicated that the user has trouble determining what the notifying means indicate.

SUMMARY OF THE INVENTION

The object of the invention is to solve the above-mentioned problems by providing a display device for a recording apparatus that is capable of notifying a user of a plurality of states of the recording apparatus using a single display means. A second object is to miniaturize the recording apparatus itself.

The present invention is directed to achieving the objects stated above and thereby solving the identified problems.

Shown in FIG. 1 is a display device for a recording device in which the power status is displayed in a display means M2 when the power supplied to the recording device M1 is switched on and which records data in accordance with input recording instructions, comprising:

a misoperation detection means M3 for detecting the misoperation in the recording device M1;

a control means for changing the display of power-on in the display means M2 during misoperation to the display of detection of the misoperation;

a device-trouble detection means M5 for detecting device-trouble of the recording device M1; and a control means for changing the display means M2 during the device-trouble period to displaying detection of the device-trouble.

In a display device for a recording device having the above-described structure, when power to the recording device M1 is switched on, the display means M2 displays power-on. When the recording device M1 is operated and recording information is input, the misoperation detection means M3 detects misoperation should such occur. When the misoperation detection means M3 detects a misoperation, the control means M4 directs the display means M2 to display detection of a misoperation. When the device-trouble detection means M5 detects a problem in the recording device M1, the control means M6 directs the display means M2 to display the detection trouble, the display being different from the display of power-on or the display of misoperation.

BRIEF DESCRIPTION OF THE DRAWINGS

The above and other objects, features and advantages of the invention will become more apparent from reading the following description of the preferred embodiment taken in connection with the accompanying drawings in which:

FIG. 4B are labels associated with the steps of FIG. 4A;

DETAILED DESCRIPTION OF THE PREFERRED EMBODIMENT

Referring to the accompanying drawings, a preferred embodiment of the invention will be described in detail.

Figure 1:
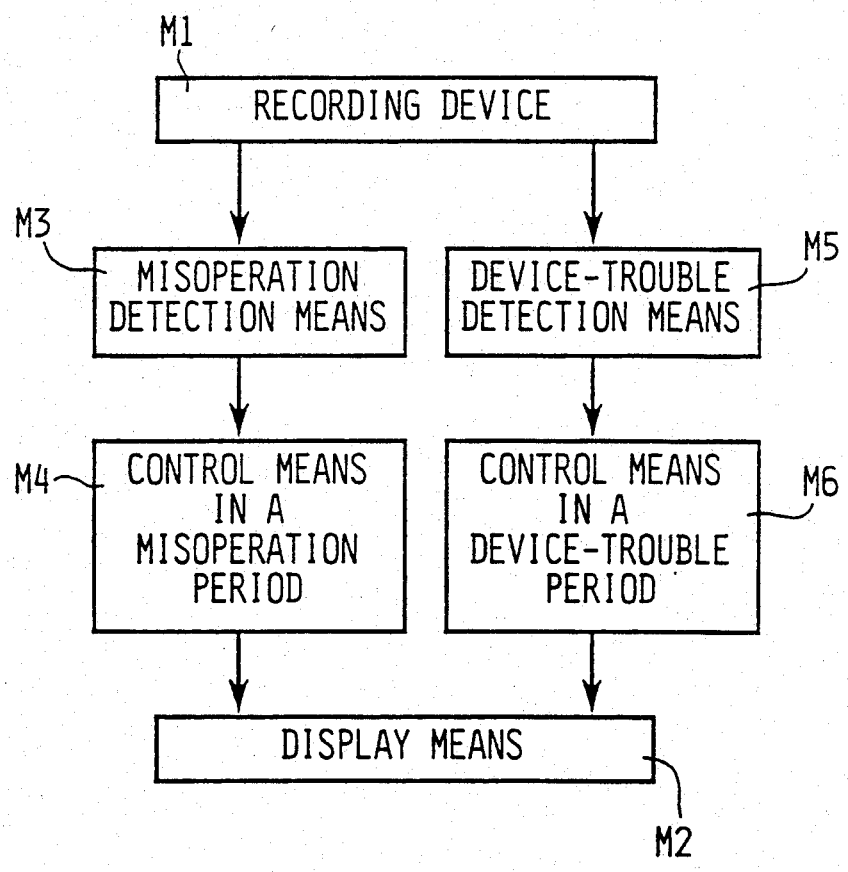
FIG. 1 is a block diagram of a display device for a recording device.
Figure 2:
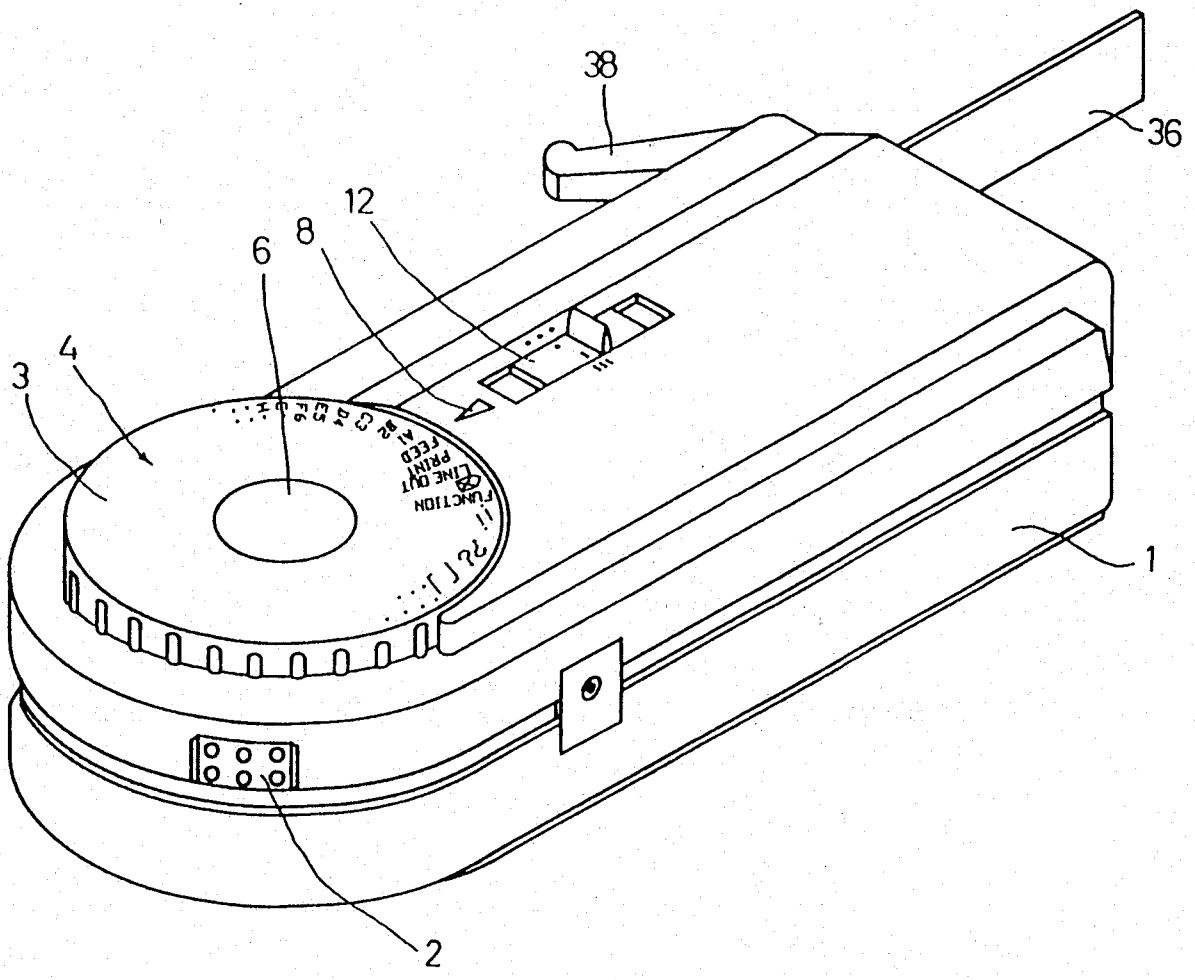
FIG. 2 is a perspective view of the recording device in which the display device for the recording device is used.

FIG. 2 is a perspective view of a recording device in which a display device of the present embodiment is used. A main body case 1 has provided thereon a power switch 2 for turning the power supply ON/OFF. Also provided on the main body case 1 is a dial key 4 with a rotatable dial 3. Characters such as alphabetical letters A, B, C, . . . , numerals, or a plurality of indicators showing specific functions, such as "PRINT" and "FEED", are shown as labels on the surface of the dial 3. When one of the labels, among the plurality of labels shown on the surface of the dial 3, is brought to the position aligned with a display window 8, by the user rotating the dial 3, a signal corresponding to the label can be input to an electronic control circuit 20 from the dial key 4.

An enter key 6 is provided in the center of the dial key 4. When the enter key 6 is depressed by a user, a signal corresponding to the label aligned with the display window 8 is input to the electronic control circuit 20. The display window 8, having a triangular shape, is formed on the main body case 1 in the vicinity of the outer periphery of the dial 3 so that the light of a light emitting diode 10 can be observed by lighting the display window 8. In the present embodiment, the display window 8 and the light emitting diode 10 constitute a display means M2. Further, a slide switch 12 which can be switched to 3 positions, "STYLE", "SIZE" and "DENSITY", is provided on the main body case 1.

Figure 3:
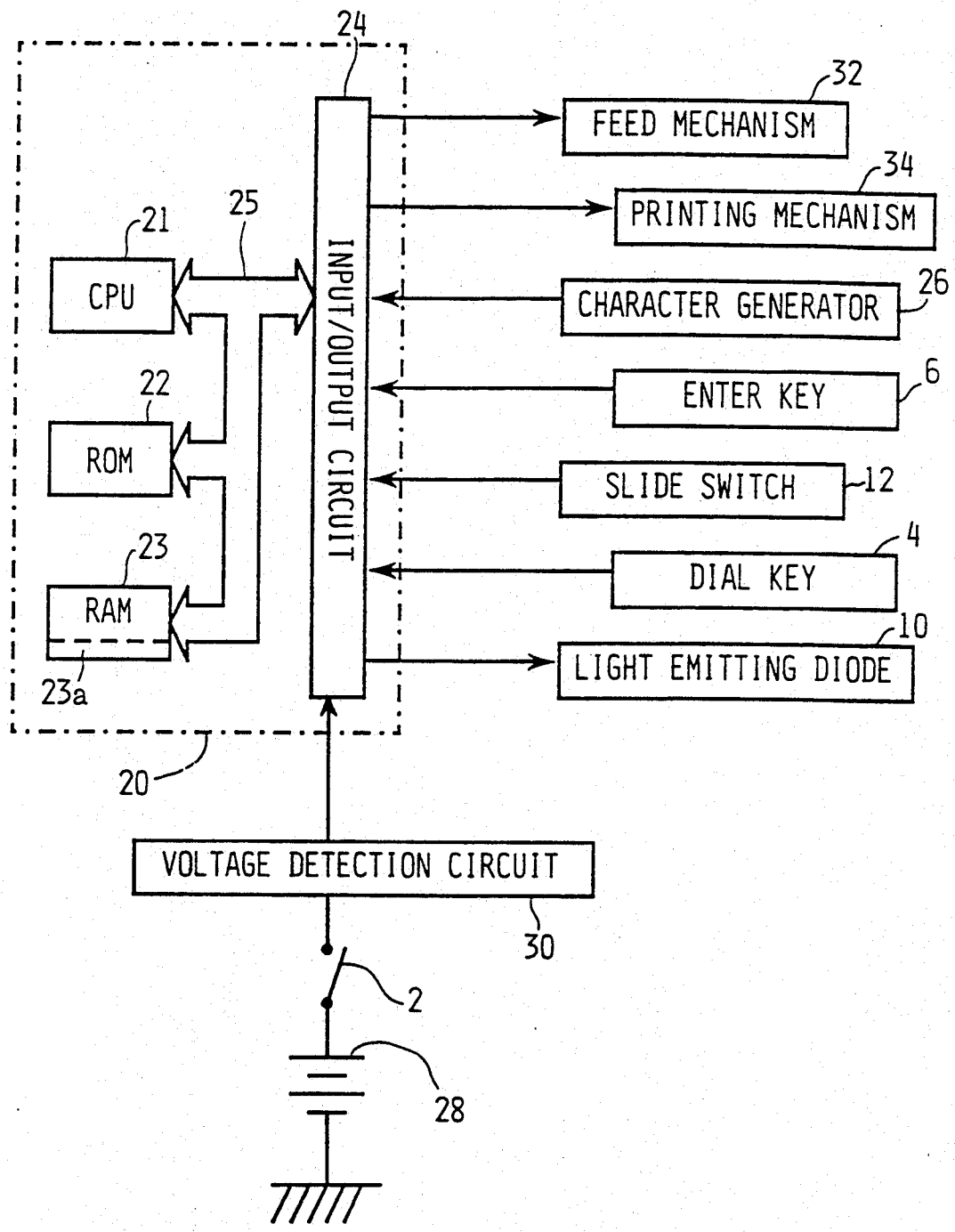
FIG. 3 is a block diagram showing the structure of the electronic system.

The dial key 4, the enter key 6, the light emitting diode 10, and the slide switch 12, in addition to other elements to be described later, are connected to an electronic control circuit 20. The electronic control circuit 20 comprises a CPU (Central Processing Unit) 21, a ROM (Read Only Memory) 22 and a RAM (Random Access Memory) 23 as principal components of the logic operation circuit shown in FIG. 3. The CPU 21, ROM 22 and RAM 23 are connected to an input/output circuit 24 through a common bus 25. Input/output circuit 24 provides the interface with the external equipment. A line buffer 23*a* which has the capacity of registering 45 characters is provided in the RAM 23.

A signal corresponding to a label identifying a specific function, which is positioned facing the display window 8 by turning the dial 3, can be input to the CPU 21 through the input/output circuit 24. A voltage detection circuit 30 is provided to detect the voltage of a battery 28 housed in the main body case 1. When the voltage drops lower than a minimum voltage for maintaining functions of the device, such as a feed mechanism 32 or a printing mechanism 34, the voltage detection circuit outputs a trouble signal to the CPU 21 through the input/output circuit 24. Further, the signals from the enter key 6, slide switch 12, and dial key 4 are input to the CPU 21 through the input/output circuit 24. The printing patterns corresponding to the characters indicated on the dial 3 are stored in a character generator 26 and they are also input to the CPU 21 through the input/output circuit 24.

The CPU 21 is also configured to control the feed mechanism 32 and the printing mechanism 34 by outputting driving signals through the input/output circuit 24 for driving them based on the above-mentioned signals, the programs or the data in the ROM 22 or the RAM 23. The feed mechanism 32 and printing mechanism 34 are provided inside the main body case 1 The feed mechanism 32 feeds a printing tape 36 upon receipt of a signal from the CPU 21. The printing mechanism 34, upon receipt of a signal from the CPU 21, prints the information registered in the line buffer 23*a*.

The control processing performed in the electronic control circuit 20 will be explained referring to the flow charts shown in FIGS. 4A, 4B and 5.

Figure 6A:
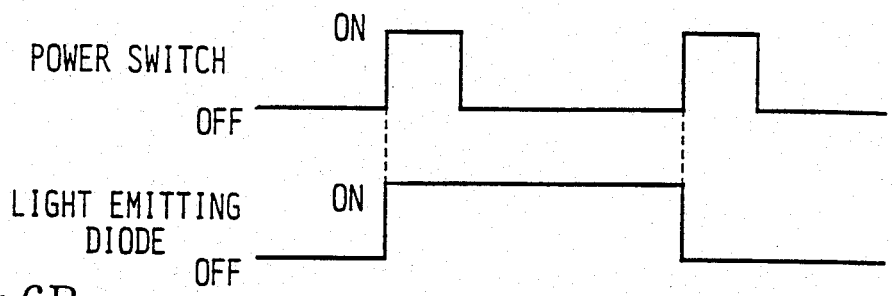
FIGS. 6A–6D are time charts for explaining the on-and-off operation of a light emitting diode.
Figure 6B:
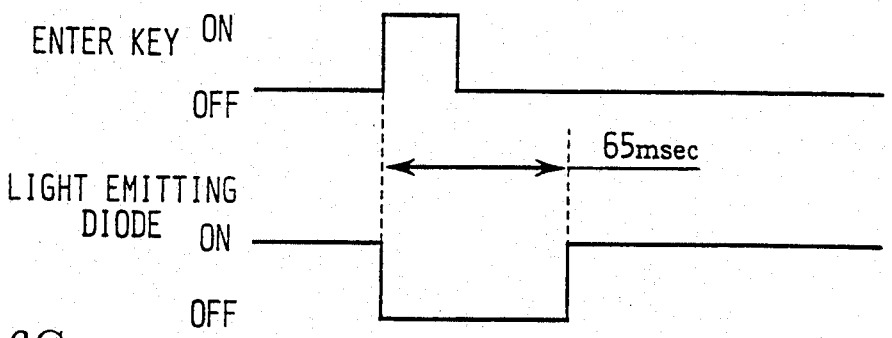

When the power switch 2 is depressed, power is supplied to the recording device and, as shown in FIG. 6A, a light emitting diode is lighted and remains lit until the power switch 2 is turned OFF except for the period when it indicates to a user the various states of the recording device. The user selects a character which he/she wants to print by placing the character in the position aligned with that of the display window 8 by turning the dial 3. Following the alignment of the selected character, the user depresses the enter key 6. The code of the character is then registered in the line buffer 23*a* by the input control process to be explained in conjunction with FIGS. 4A and 4B. The user depresses the enter key 6 each time he/she selects a character to register the code of the selected character in the line buffer 23*a;* thus the recording information which the user is going to print is formed. Every 10 msec an enter scan is executed, and when the enter key 6 is in a depressed state, the input control process is executed. When the enter key 6 is depressed, the light emitting diode 10 is turned OFF for 65 msec, as shown in FIG. 6B, to notify the user the enter key 6 has been depressed.

Figure 4A:
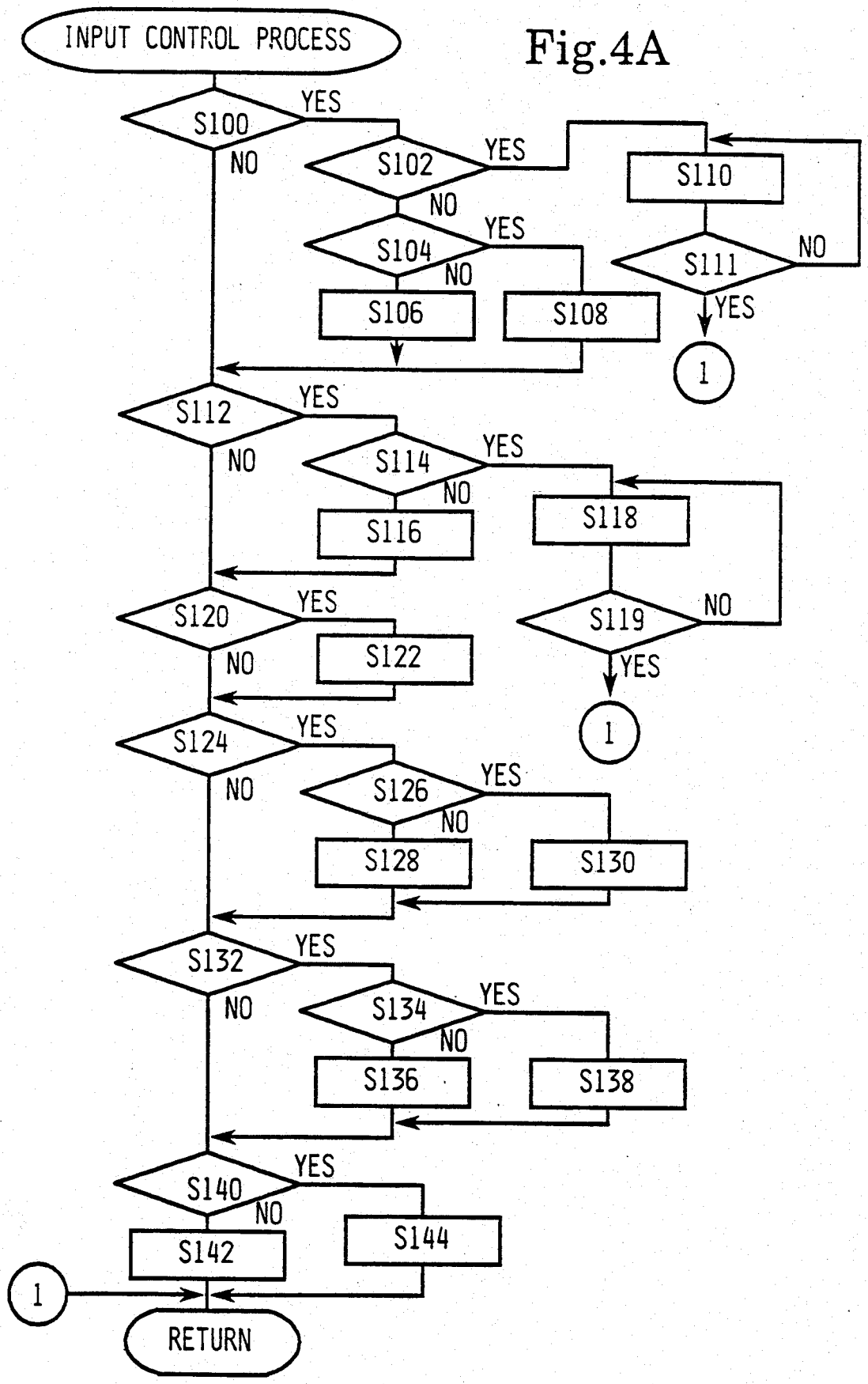
FIG. 4A is a flow chart showing an example of an input control process which is to be performed in the electronic control circuit.

The input control process is shown in FIGS. 4A and 4B. When the enter key 6 is depressed, the CPU 21 judges whether the indication "PRINT" on the dial 3 is aligned with the display window 8 (step 100, hereinafter referred to as S100; the same rule applies to all steps). When the CPU 21 judges that "PRINT" is aligned with the display window 8, it judges whether, a "battery weak" state exists based on the existence of a trouble signal from the voltage detection circuit 30 (S102). If the voltage of the battery 28 is lower than a specified value, the battery is in a state where there is not enough stored power to drive the feed mechanism 32 or the printing mechanism 34, that is, the device is in a trouble state and a trouble signal is output from the voltage detection circuit 30. The "battery weak" state is judged before the printing process to prevent the printing process from being suspended. Since considerable power is consumed when the feed mechanism 32 or the printing mechanism 34 is driven, the battery voltage can be lowered during the printing process and the process may be suspended.

When the trouble signal is not output, in the next step the CPU 21 judges if the state is in "error" (S104). Whether state is in "error" or not is judged by the existence of a character registered in the line buffer 23*a*. If no character is registered, the state is in "error" as there is no character to be printed and the CPU 21 makes that judgment. When the CPU 21 judges that the state is not in "error", that is, when characters are registered in the line buffer 23*a*, the CPU 21 drives the print mechanism 34 and the feed mechanism 32 to execute the process of printing the characters registered in the line buffer 23*a* onto the tape 36 (S106).

Figure 6C:
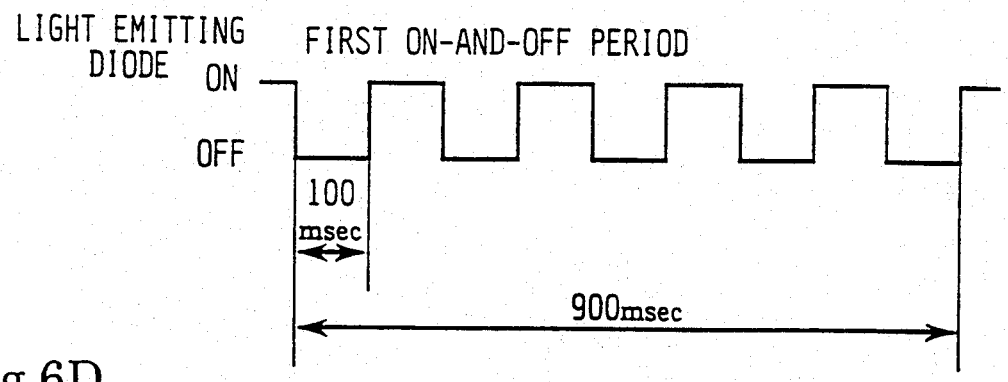
Figure 6D:
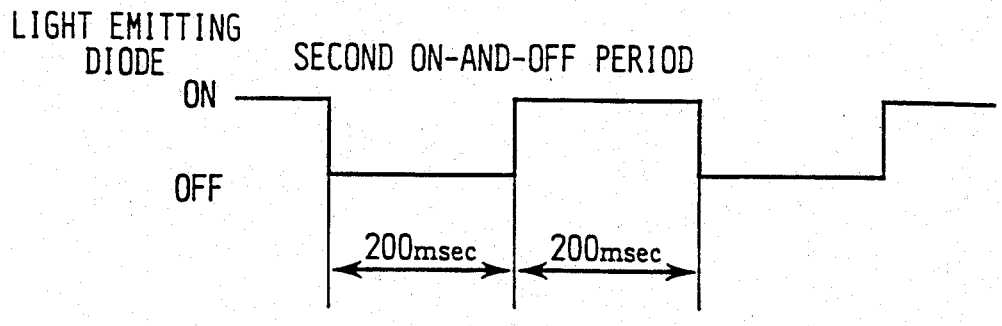

When the CPU 21 judges the state to be in "error" in S104, the CPU 21 makes the light emitting diode 10 blink on-and-off at first alternating on-and-off time periods (S108). In the present embodiment, shown in FIG. 6C, the light emitting diode is turned on-and-off for alternating 100 msec periods by the CPU 21 so that the diode 10 blinks on-and-off for a total time of 900 msec. When the CPU 21 judges the state to be "battery weak" in step S102, the CPU 21 makes the light emitting diode 10 blink on-and-off at second alternating on-and-off periods (S110) of time which are different from the first alternating on-and-off time periods In the present embodiment, shown in FIG. 6D, the second alternating on-and-off time periods are 200 msec and the CPU 21 makes the light emitting diode 10 blink on or off every 200 msec. When the second on-and-off blinking operation, indicating a battery-weak state, is being performed and the enter key 6 is depressed by a user at step the state of the recording device is reset and the device is returned to the initial state. If the enter key is not depressed at step S111, the second on-and-off blinking continues.

When the enter key 6 is depressed (S100), and the CPU 21 judges that the label aligned with the display window 8 is not "PRINT", then the CPU 21 judges whether the label aligned with the display window 8 is "FEED" (S112). If the CPU 21 judges that "FEED" is aligned with the display window 8, the CPU 21 determines whether the device state is in a "battery weak" state (S114) similar to step S102. The reason why the CPU 21 judges if the device state is in "battery weak" state before the execution of the feed process is to prevent the suspension of the feed process due to the lowering of the battery voltage because of excessive consumption of power in driving the feed mechanism 32. If the CPU 21 judges that the device state is not in "battery weak" state, the CPU 21 drives the feed mechanism 32 to execute the process of feeding the printing tape 36 (S116). When the CPU 21 determines the device state is in the "battery weak" state, the CPU 21 makes the light emitting diode 10 blink on or off at the second alternating on-and-off time periods (S118) similar to the process in S110. When the second on-and-off blinking operation is being performed, and the enter key 6 is depressed by a user (S119), the state of the recording device is reset and returned to the initial state If the enter key is not depressed at step S119, the second on-and-off blinking continues.

When the enter key 6 is depressed at S120, the CPU 21 judges if the label aligned with the display window 8 is "FUNCTION". If the CPU 21 judges that "FUNCTION" is aligned with the display window 8, the CPU 21 executes a function mode process (S122). The function mode is a mode for setting the size or the style of characters to be printed or the depth of printing. These settings are obtained from the settings of the slide switch 12 or from the dial key 4 and are performed by the execution of the function-mode process. The relationships between the switching positions, or settings, of the slide switch 12 and the indications on the dial 3 aligned with the display window 8 are shown in Table 1.

For example, when the slide switch is in the position of "SIZE" and the letter "D" on the dial 3 is aligned with the display window 8, the size of a character to be printed will be four times as large as normal size.

TABLE 1

| Slide Switch | Dial | Setting |
|---|---|---|
| Size | A | Normal |
| | B | Double width |
| | C | Double height |
| | D | 4 times |
| | E | 8 times |
| Style | A | Normal |
| | B | Framed character |
| | C | Thick character |
| | D | Shaded character |
| | E | Characters in a column |
| Density | A | Light printing |
| | B | Normal printing |
| | C | Deep printing |

Figure 5:
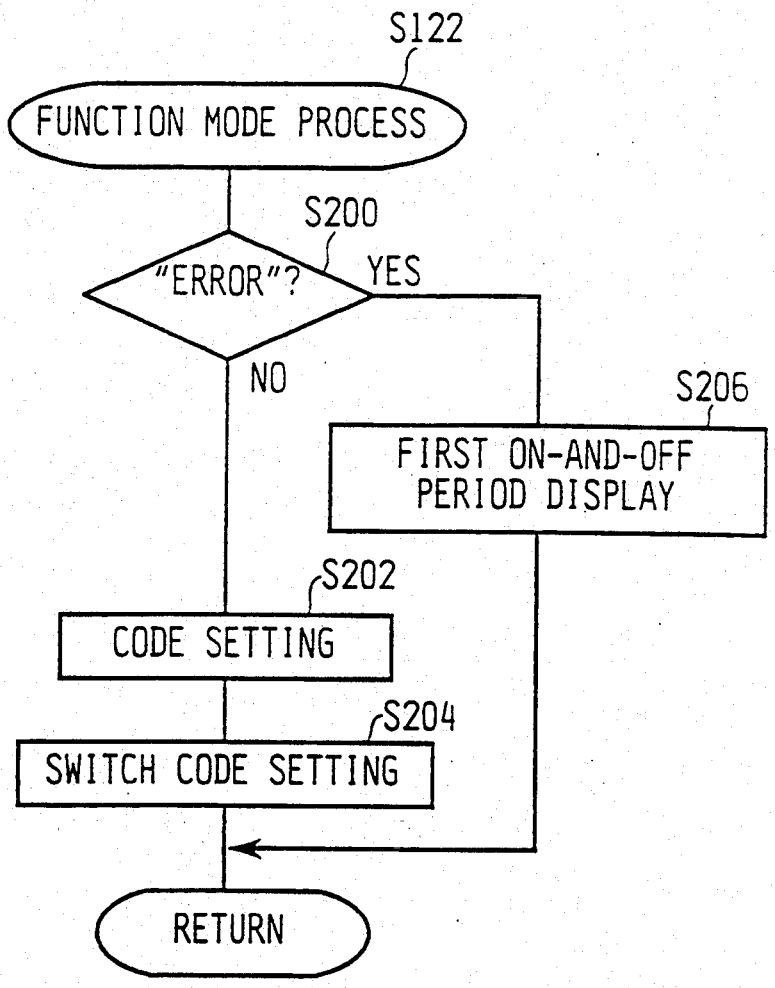
FIG. 5 is a flow chart showing an example of a function mode process in the present embodiment.

The function mode process is executed when the enter key 6 is depressed again and the CPU 21 then judges if the state is in "error" as shown in FIG. 5 (S200). The judgment whether the state is in "error" or not is made by judging whether or not the setting on the dial key 4 is in a correct range. In other words, when the slide switch 12 is positioned at "SIZE", the acceptable range for the dial key 4 is A through E. Therefore, if a label outside the range, for example, F, is aligned with the display window 8, it is a misoperation, or operator error, and the CPU 21 judges the state to be in "error".

If the state is judged not to be in "error", the code indicated by the dial key 4 is set (S202) and a switch code set by the slide switch 12 is set (S204). On the other hand, when the state is judged to be in "error", the CPU makes the light emitting diode 10 blink on-and-off for the first alternating on-and-off time periods (S206) similar to the process in S108.

When the enter key 6 is depressed (S120) and the CPU 21 judges that the label aligned with the display window 8 is not "PRINT", "FEED" or "FUNCTION", the CPU 21 judges if the label aligned with the display window 8 is "LINEOUT" (S124). When the CPU 21 judges that the label is "LINEOUT", then the CPU 21 judges if the state is in "error" (S126). In this case, the judgment for "error" is made by determining whether even a single character is registered in the line buffer 23*a*. If no character is registered, it is in a misoperational state with no character to be cleared in the line buffer 23*a* and the CPU 21 judges the state to be in "error". When the CPU 21 judges the state not to be in "error", that is, when at least one character is registered in the line buffer 23*a*, the CPU 21 executes a process to clear the whole range of the line buffer 23*a* (S128). When the CPU 21 judges the state to be in "error", the CPU 21 makes the light emitting diode 10 blink on-and-off for the first alternating on-and-off time periods (S130) similar to the process in S108.

At the next step (S132), if the enter key 6 is depressed, the CPU 21 judges if the label aligned with the display window 8 is "DELETE". When the CPU 21 judges the label is "DELETE", the CPU 21 then judges if the state is in "error" (S134). The judgment of an "error" state is whether any character is registered in the line buffer 23*a*. If no character is registered in the line buffer 23*a*, it is in a misoperational state as there is no character to be deleted, so that the CPU 21 judges the state to be in "error". When the CPU 21 judges the state not to be in "error", that is, a character is registered in the line buffer 23*a*, the CPU 21 executes a process to delete the character which the user desires to delete from among the characters registered in the line buffer 23*a* (S136). On the other hand, when the CPU 21 judges the state to be in "error", the CPU 21 makes the light emitting diode 10 blink on-and-off for the first alternating on-and-off time periods (S138) similar to the process in S108.

Next, the CPU 21 judges whether the following step is the input of a character and, further, if the state is in "error" (S140). In this case, the judgment whether the state is in "error" or not is made on the basis of whether the number of characters is more than 45. More than 45 characters cannot be registered in the line buffer 23*a*, so that the registration of more than 45 characters becomes a misoperation and the CPU 21 judges the state to be in "error". When the CPU 21 judges the state not to be in "error", that is, when the registered characters are less than 45 characters, the CPU 21 executes a process to register the codes of the characters in the line buffer 23*a* (S142). When the CPU 21 judges the state to be in "error", the CPU 21 makes the light emitting diode 10 blink on-and-off for the first alternating on-and-off time periods (S144) similar to the process in S108.

After executing above-mentioned processes, and after the CPU 21 has printed the characters on the printing tape 36, the user operates a cutting lever 38 to cut the printing tape 36. When the user has finished the operation, the user will turn off the power switch 2 which also turns the light emitting diode 10 off.

In the present embodiment: the execution of the process in S104, S126, S134, S140 or S200 operates as the misoperation detection means M3; the execution of the process in S108, S130, S138, S144 or S206 operates as the control means in a misoperation period M4; the execution of the process in S102 or S114 works as the device-trouble detection means M5; and the execution of the process in S110 or S118 works as the control means in the device-trouble period M6.

In the present embodiment, only the lowering of the battery voltage is detected as device-trouble, but the invention is not limited to such; it may be also considered to be within the scope of the invention to detect the impossibility of feeding the printing tape or the incompletion of printing caused by exhaustion of the printing tape as device-troubles.

The first alternating on-and-off time periods, the second alternating on-and-off time periods and the further on-and-off period when the enter key 6 is depressed are not limited to the periods described in the present embodiment.

As described above, in the display device for the recording device described in the present embodiment, the light emitting diode 10 is turned on when the power is switched on. For a misoperation period, a light emitting diode 10 is made to blink on-and-off for the first alternating on-and-off time periods for a predetermined length of time, and during a device-trouble period the light emitting diode 10 is made to blink on-and-off for second alternating on-and-off time periods. Therefore, even through only one light emitting diode 10 is used, it can inform the user of power-on, misoperation and device-trouble making it possible to miniaturize the display device. The small size is especially effective for a handheld type recording device as in the case of the present embodiment.

In the present embodiment, in S100, after it is judged by the CPU 21 that the label on the dial 3 aligned with the display window 8 is "PRINT", the CPU 21 judges if the device is in a "battery weak" state with the process of S102. The present invention is not limited to just this sequence is the following sequence also possible.

After the process in S100, the CPU 21 can judge if the state is in "error" in S104. If it is not in "error", the CPU 21 can execute the printing process in S106. During the printing process, the CPU 21 detects the "battery-weak" state, and after the finish of the printing process, the CPU 21 judges if the state is in the "battery weak" state similar to the process in S102, and if it is in the "battery weak" state, the CPU 21 can execute the process in S110. For the process of S114, the following procedure is also applicable: in the process in S112, after the judgment by the CPU 21 that the label on the dial 3 aligned with the display window 8 is "FEED", the CPU 21 executes a feed process with the process of S116. During the feed process, when the CPU 21 detects the "battery weak" state, and after the finish of the feed process, the CPU 21 judges if the state is in the "battery weak" state similar to the process in S114. If the state is "battery weak", the CPU 21 can execute the process of S118.

Various kinds of device states can be displayed with different kinds of color display lamps in place of the single display with various alternating on-and-off time periods over differing lengths of time.

Figure 7:
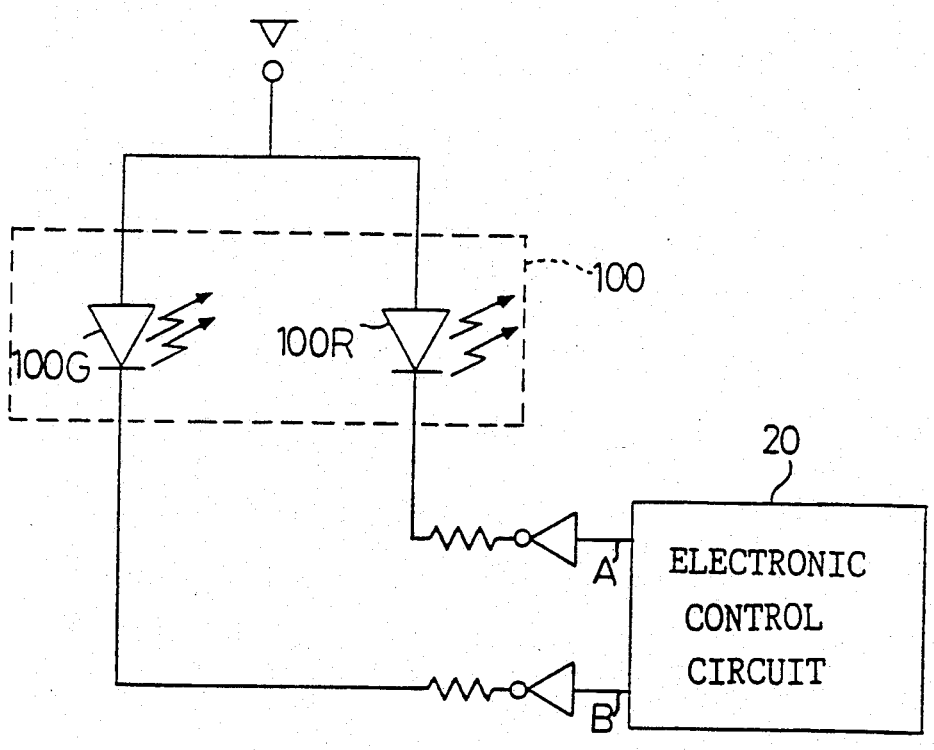
FIG. 7 is a block diagram showing the structure of another LED system.

In FIG. 7, when a light emitting diode 100 is used, which contains a light emitting diode 100R which emits red light and a light emitting diode 100G which emits green light, the light emitting diode 100 can display 3 colors as shown in Table 2 corresponding to a High/-Low signal output from the CPU to be input through lines A and B connected to the two light emitting diodes 100R and 100G. For example, assuming that when the signal output in line A is High, the signal output in line B is Low only the light emitting diode 100R is turned ON, and the light emitting diode 100 emits red light. In the similar way, when the signal output in line A is Low, the signal output in line B is High and only the light emitting diode 100G is turned ON. Thus, the light emitting diode 100 emits green light. Further, if both the signal outputs in lines A and B are High, both light emitting diodes 100R and 100G are turned ON, and the light emitting diode 100 emits yellow light. Therefore, these colors, red, green and yellow, can be made to correspond to the notification of power-on, the notification of low voltage and the notification of a misoperation.

The light emitting diodes are not limited to a red light emitting diode and a green light emitting diode.

TABLE 2

| | A | |
|---|---|---|
| B | L | H |
| L | OFF | RED |
| H | GREEN | YELLOW |

The present invention is not limited to the above-mentioned embodiments. It will be understood that various modifications may be made within the scope of the invention.

As described in detail above, even though a display device for a recording device according to the present invention is provided with only one light emitting diode, it can notify a user of a plurality of states of the recording device, such as power ON/OFF, misoperation or device-trouble, which makes it possible to miniaturize the recording device. When the recording device is a handheld type, the effect of the invention is especially advantageous.

What is claimed is:

1. A display device for a recording apparatus having a line buffer and a data input mechanism, comprising:

a display means for selectively displaying one of a power-on state and a misoperation state resulting from a user's misoperation of the recording apparatus;

a misoperation detection means for detecting the user's misoperation; and a control means for controlling the display means so as to change a display of the display means from the power-on state to the misoperation state upon detection of the user's misoperation by said misoperation detection means, wherein the user's misoperation comprises inputting an improper operating command for an operating state of the recording apparatus, said improper operating command comprising a command from one of a group of operations consisting of directing a print operation, a lineout operation, and a delete operation when the line buffer is empty; selecting a function operation from a group of functions and issuing a subsequent execution command that is outside an allowable range of execution commands; and inputting a character when the line buffer contains a predetermined number of characters.

2. A display device for a recording apparatus according to claim 1, wherein said display means comprises a display lamp.

3. A display device for a recording apparatus according to claim 2, wherein the display for the power-on state comprises continuous lighting of the display lamp and the display for the misoperation state comprises blinking the display lamp for alternating on-and-off time periods for a predetermined length of time.

4. A display device for a recording apparatus according to claim 3, wherein said control means changes the display of the display means from the power-on state to an input state where said display lamp is turned off for a specified time duration when information is input to the recording apparatus.

5. The display device according to claim 1, wherein said display means is located near an inputting means which is provided in the recording apparatus, said inputting means for inputting at least one of a character and an operating command.

6. A display device for a recording apparatus comprising:

a display means for selectively displaying one of a power-on state and a device-trouble state resulting from a potentially defective operation of the recording apparatus;

a device-trouble detection means for detecting the potentially defective operation of said recording device; and a control means for changing the display of the power-on state in said display means to the display of the device-trouble state upon detection of said potentially defective operation, wherein the potentially defective operation is one in which if the operation were to be started, the recording apparatus might fail to complete execution of the operation, said device-trouble detection means detecting a battery low state indicating an inability of the recording apparatus to perform one of a group of operations consisting of printing and feeding a recording medium.

7. A display device for a recording apparatus according to claim 6, wherein said display means comprises a display lamp.

8. A display device for a recording apparatus according to claim 7, wherein the display for the power-on state comprises continuous lighting of the display lamp and the display for the device-trouble state comprises blinking the display lamp for alternating on-and-off time periods.

9. A display device for a recording apparatus according to claim 8, wherein said control means changes a display of the display means from the power-on state to an input state where said display lamp is turned off for a specified time duration when information is input to the recording apparatus.

10. A recording apparatus comprising:

a display means for selectively displaying one of a power-on state of a power supply switch and a misoperation state resulting from a user's misoperation of the recording apparatus;

a misoperation detection means for detecting the user's misoperation of the recording device;

a first control means for controlling the display means so as to change a display state of the display means from the power-on state to the misoperation state upon detection of the user's misoperation;

a device-trouble detection means for detecting potentially defective operation of the recording apparatus; and a second control means for changing said display means to display the detection of a potentially defective operation state of the recording device, the display of the potentially defective operation state being different from the display of the power-on state and the display of the misoperation state, wherein the potentially defective operation is one in which if the operation were to be started, the recording apparatus might fail to complete execution of the operation.

11. A display device for a recording apparatus according to claim 10, said display means comprising:

a display window; and at least two display lamps for illuminating said display window, each lamp having a different color.

12. A recording apparatus according to claim 11, wherein the display of the power-on state comprises the lighting of a first display lamp of a first color, the display of the misoperation state comprises the lighting of a second display lamp of a second color different from the color of the display lamp indicating power-on, and the display of the device-trouble state comprises a simultaneously lighting the first and second display lamps to create a third color different from the color for the power-on state and the color for the misoperation state.

13. A recording apparatus according to claim 10, wherein said display means comprises a display lamp, the display of the power-on state comprises the lighting of the display lamp, the display of the misoperation state comprises blinking of the display lamp for first alternating on-and-off time periods for a predetermined length of time, and the display of the device-trouble state comprises blinking of the display lamp for second alternating on-and-off time periods differing from the first alternating on-and-off time periods of the display lamp for the misoperation state.

14. A recording apparatus according to claim 13, wherein said control means changes a display of the display means from the power-on state to an input state where the display lamp is turned off for a specified time duration when information is input to the recording apparatus.

* * * * *